US005894808A

United States Patent [19]

Miyoshi

[11] Patent Number: 5,894,808

[45] Date of Patent: Apr. 20, 1999

[54] FLOATING DEPOSIT REMOVAL SYSTEM

[76] Inventor: Isao Miyoshi, 7-38, Hiyoshi-cho 1-chome, Tomakomai-shi, Hokkaido, Japan

[21] Appl. No.: 08/955,712

[22] Filed: Oct. 23, 1997

[30] Foreign Application Priority Data

Jun. 20, 1997 [JP] Japan ..... 9-164374

[51] Int. Cl.[6] ..... B63B 59/08

[52] U.S. Cl. ..... 114/222; 15/104.04; 405/211

[58] Field of Search ..... 114/222; 405/211; 15/104.04

[56] References Cited

U.S. PATENT DOCUMENTS

| | | | |
|---|---|---|---|
| 1,266,050 | 5/1918 | Reynolds | 405/211 |
| 1,279,732 | 9/1918 | Lockwood | 405/211 |
| 4,843,995 | 7/1989 | Bingham | 114/222 |
| 5,040,923 | 8/1991 | Do | 114/222 |

FOREIGN PATENT DOCUMENTS

| | | |
|---|---|---|
| 56-138932 | 10/1981 | Japan . |
| 60-15786 | 5/1985 | Japan . |

*Primary Examiner*—Sherman Basinger
*Attorney, Agent, or Firm*—Howson and Howson

[57] ABSTRACT

A system for removing deposits from an underwater structure comprises a series of interconnected dog members which can be formed into a ring and adjusted angularly relative to one another to conform to the underwater structure. The series of dog members is supported by floats, which allow a preassembled line of dog members to be moved into position and wrapped around an underwater structure. The free ends of the line of dog members are connected together by a pin having a latching spring which can be operated easily underwater. Multiple rings can be used, one above another. An annular net, secured to concentric rings and suspended underneath one or more deposit removal rings, catches dropped deposits. The inner one of the concentric rings can also be used as a deposit removal ring. The dogs can also be disposed in a vertical ring for removal of deposits from a horizontal underwater structure, and a suspended basket is used to catch dropped deposits. For removal of deposits from the hull of a ship, an arrangement consisting of two longitudinal deposit removal structures extending alongside the ship, and multiple parallel transverse deposit removal structures extending underneath the hull, is used.

18 Claims, 13 Drawing Sheets

FLOATING DEPOSIT REMOVAL SYSTEM

BACKGROUND OF THE INVENTION

1. Field of the Invention

This invention relates to a floating deposit removal system for removing deposits from an underwater structure. Typical underwater structures to which the invention is applicable include vertical, perpendicular and angular piles made of steel, concrete or other materials, including H-shaped piles, steel pipes, horizontal rods, legs of piers or of other structures, piles of offshore structures such as sea berths, artificial islands or the like, banks and bottoms of ships.

2. Description of Related Art

In the maintenance of such underwater structures, deposits such as shells, seaweed, rust, or sludge have been removed from the surfaces of the structures by human power with a chaplet rod or wire brush.

However, there are hundreds to thousands of such structures for which deposit removal is performed at sea. The time available for deposit removal is limited because of tides and weather conditions. Moreover, numerous workers and divers are required. Thus, the need for deposit removal from fixed underwater structures is an important factor contributing to high construction costs, instability in construction scheduling, and serious safety concerns. The need for underwater deposit removal gives rise to similar cost, scheduling and safety problems in the building and maintenance of ships.

Various efforts are made to prevent deposits, particularly marine organisms such as shells and seaweed, from easily attaching themselves to an underwater structure or the bottom of a ship. For example, special paints are frequently applied. However, it is impossible to prevent the attachment of deposits completely. Therefore, it is necessary to remove the deposits from time to time.

Devices for solving these problems are described in Japanese Utility Model Publication No. 60-15786 and Japanese laid-open Utility Model Application No. 56-138932).

The first of the above-mentioned Japanese publications discloses a device comprising a divisible cylindrical floating body and an annular frame secured to a support extending downward from the floating body. An edged portion is provided on the inner periphery of the floating body and/or on the frame so that, when the floating body and frame are installed on a steel-pipe pile, the tide and waves cause the floating body to travel vertically, and the edged portions slide on the pile to scrape away deposits from its surface.

The second of the above-mentioned Japanese publications discloses a device comprising an annular body installed onto a pile or the like of an offshore structure and having an internal space and an opening at the bottom of the body communicating with the internal space. A wing is provided on the outer periphery of the annular body, and a grinding and cleaning material is provided on the inside of the annular body. A gas spouting hole at the bottom of the pile releases gas, which fills the internal space, causing the body to rise on the pile due to increased buoyancy. The internal space within the body then fills with water, the body falls under its own weight while the wing supplies rotating torque. As this action occurs, the grinding and cleaning material cleans the surface of the pile.

The prior art devices disclosed in these two publications are able to remove deposits from a vertical pile. However, their effectiveness is limited because the movement of removal member (the edged portion of the first device or the grinding and cleaning material of the second) is dependent upon tides, waves, or the weight and buoyancy of a floating body. Moreover, such devices are not suitable for use in connection with slanted piles.

SUMMARY OF THE INVENTION

This invention addresses the problems encountered in the use of conventional deposit removal tools and equipment, and its primary object is to provide a floating-type deposit removal system capable of effectively removing deposits from underwater structures having any shape, including horizontal underwater structures, by moving a removal member provided with a float not only vertically but also in any direction in response to the tides and wave motion. Another object of the invention is to achieve more effective deposit removal from various underwater structures by providing a removal member capable of adjusting to accommodate the shape of the underwater structure.

Still another object of the invention is to provide a floating-type deposit removal system capable of catching removed deposits so that they are not deposited on the sea bottom or scattered in the sea water.

A further object of the present invention is to provide a floating-type deposit removal system capable of removing deposits from the bottom of a ship in response to wave motion and tidal forces.

The floating-type deposit removal system in accordance with the invention comprises an elongate deposit removal structure adapted to contact a surface of an underwater structure in a body of water, and at least one supporting float connected to the deposit removal structure and adapted to float on the surface of said body of water. The deposit removal structure is constituted by a plurality of dog members arranged in series along the length of the deposit removal structure, with adjacent dog members linked to each other by a fastener which permits articulation of the adjacent dog members relative to each other so that the shape of the deposit removal structure can be adjusted to accommodate the shape of the underwater structure. The deposit removal structure is moved in all directions by waves and tides, including tidal currents, and is thus brought into contact with the underwater structure to remove deposits.

Preferably in the case of removal of deposits from a pile or a brace of an underwater structure, the dog members are disposed in a ring. Each dog member has two opposite ends, with a tongue at one end and a tongue-receiving slot at the other end, the tongue of each dog member having upper and lower horizontal faces and being received in a tongue-receiving slot of an adjacent dog member. Each slot having upper and lower horizontal surfaces in contact respectively with the upper and lower horizontal faces of a tongue, and each fastener which links a pair of adjacent dog members together and permits articulation thereof extends vertically through the upper and lower horizontal surfaces of one of the dog members of the pair and through the tongue of the other dog member of the pair.

In this case of a deposit removal structure in the form of a ring, it is possible to maintain the ring in a shape conforming to the outline of the underwater structure. The interconnected dog members forming the ring can be fixed in the appropriate angular relationship to one another so that the ring conforms closely to the underwater structure. Thus it is possible to adjust the shape of the ring and to remove deposits by moving the deposit removal ring vertically along the underwater structure. Alternatively, the dog members can be loosely connected together so that the shape of the ring is self-adjusting.

For removal of deposits from a vertical pile, the dog members are preferably disposed in a horizontal ring. In a preferred floating-type deposit removal system, all of the supporting floats are arranged radially outward of the ring. This arrangement of floats is highly durable, in that deterioration of the floats due to contact with the underwater structure is prevented. Moreover, this arrangement effectively uses the entire margin of the deposit removal ring to contact the underwater structure.

An optional second deposit removal ring, similarly constituted by a plurality of dog members, is connected to the first ring through a hoisting accessory and the rings are disposed in separate planes, one above the other. Both rings move vertically under the influence of wave and tidal force to remove deposits.

An annular retriever may be suspended from the float or floats, for catching removed deposits so that the deposits do not drop to the sea bottom. In the case of the structure having two rings, one above the other, the retriever may be suspended directly from the lower ring so that it catches deposits removed by both rings.

At least in the case of a horizontal deposit removal ring, the retriever preferably comprises a net which is ring-shaped in plan view. The net remains immediately under the ring or rings, following their movement.

The net is supported so that its cross-sections in vertical planes through the center of the annulus are generally U-shaped. The net is supported by an inner ring and an outer ring, which are held in a fixed predetermined relationship to each other. The inner and outer rings respectively hold inner and outer margins of the net removably. Each of these net-supporting rings is made up of a plurality of dog members disposed in series, with each pair of adjacent dog members linked to each other by a fastener which permits articulation of the adjacent dog members about a vertical axis. Loops are connected to the inner and outer margins of the net, and each of a plurality of the dog members of each of the inner and outer rings has a recess receiving one of the loops and a net securing pin extending across the recess and through a loop received therein. The inner and outer net-supporting rings utilize the same materials as those which constitute the deposit removal rings.

The dog members may be fastened together articulably by a pin having a U-shaped latching spring. The spring has adjacent free ends which are inserted into holes at one end of the pin, and is bent so that it can be situated in a latching position in which it extends, from one end of the pin, around the spaced elements defining the tongue-receiving slot to a location adjacent to the opposite end of the pin. The holes in which the free ends of the spring are inserted are offset from each other so that, as the spring is moved away from the latching position the tension in the spring increases causing the spring to tend to remain in the latching position. After surrounding an underwater structure with a chain made up of interconnected dogs, a worker forms the chain into a closed ring by inserting a pin to fasten the endmost dogs together. After the pin is inserted, the U-shaped spring is rotated downward to hold the pin in place.

For removing deposits from a horizontally extending underwater structure, the dog members may be disposed in a ring lying substantially in a vertical plane. As in the case of a horizontal ring, the vertically disposed deposit removal ring can be made to conform to the shape of the horizontally extending underwater structure by selecting an appropriate number of interconnected dog members and adjusting their angles relative to one another. The vertically disposed ring moves vertically moved under the action of the tides and waves, to remove deposits. The vertical ring can be made up of dog members of the same kind as those used to make up a horizontal deposit removal ring.

A basket, suspended from the deposit removal ring may be provided for catching dropped deposits removed when the ring is brought into contact with the horizontal underwater structure, so that the deposits are prevented from accumulating on the sea bottom or being scattered in the sea.

For removal of deposits from the hull of a floating vessel, the elongate deposit removal structure extends underneath the hull of the vessel athwartship. Preferably, two elongated supporting structures extending in the fore-aft direction along opposite sides of the ship, each having a length approximately equal to the overall length of the ship. Each of plurality of elongated deposit removal structures extends athwartship underneath the hull of the ship, with one end connected to one of the two elongated supporting structures and its opposite end connected to the other of the two elongated supporting structures. These deposit removal structures are constituted by articulating dog members connected in series. Floats are connected to the elongated supporting structures, and ropes are provided for connecting the floats to the ship.

Each of the two elongated supporting structures extending in the fore-aft direction may also comprise articulating dog members arranged in series. Both sets of articulating dog members oscillate due to wave and tide action and therefore swing to rub the bottom of the ship to remove deposits.

Each of the dog members extending underneath the hull, and each of the dog members constituting the deposit removal structures extending alongside the ship is preferably curved. Along the length of each such deposit removal structure, every second dog member has its ends curved toward the hull of the ship and intervening dog members have their ends curved away from the hull. The curvature of the dog members and their irregular movement is effective to remove deposits efficiently.

Other objects and advantages of the invention will be apparent from the following preferred embodiments of the invention, which are described below with reference to the accompanying drawings.

DESCRIPTION OF THE PREFERRED EMBODIMENTS

FIGS. 1 to 6 depict a first embodiment of the invention, in which a floating-type deposit removal system A comprises a deposit removal ring 1 made up of a plurality of dog members 11, connected in series with one another by fasteners 2. Floats 3 are attached to the deposit removal ring 1, by fittings 4 in such a way that the floats are disposed radially outward of the ring.

Figure 2:
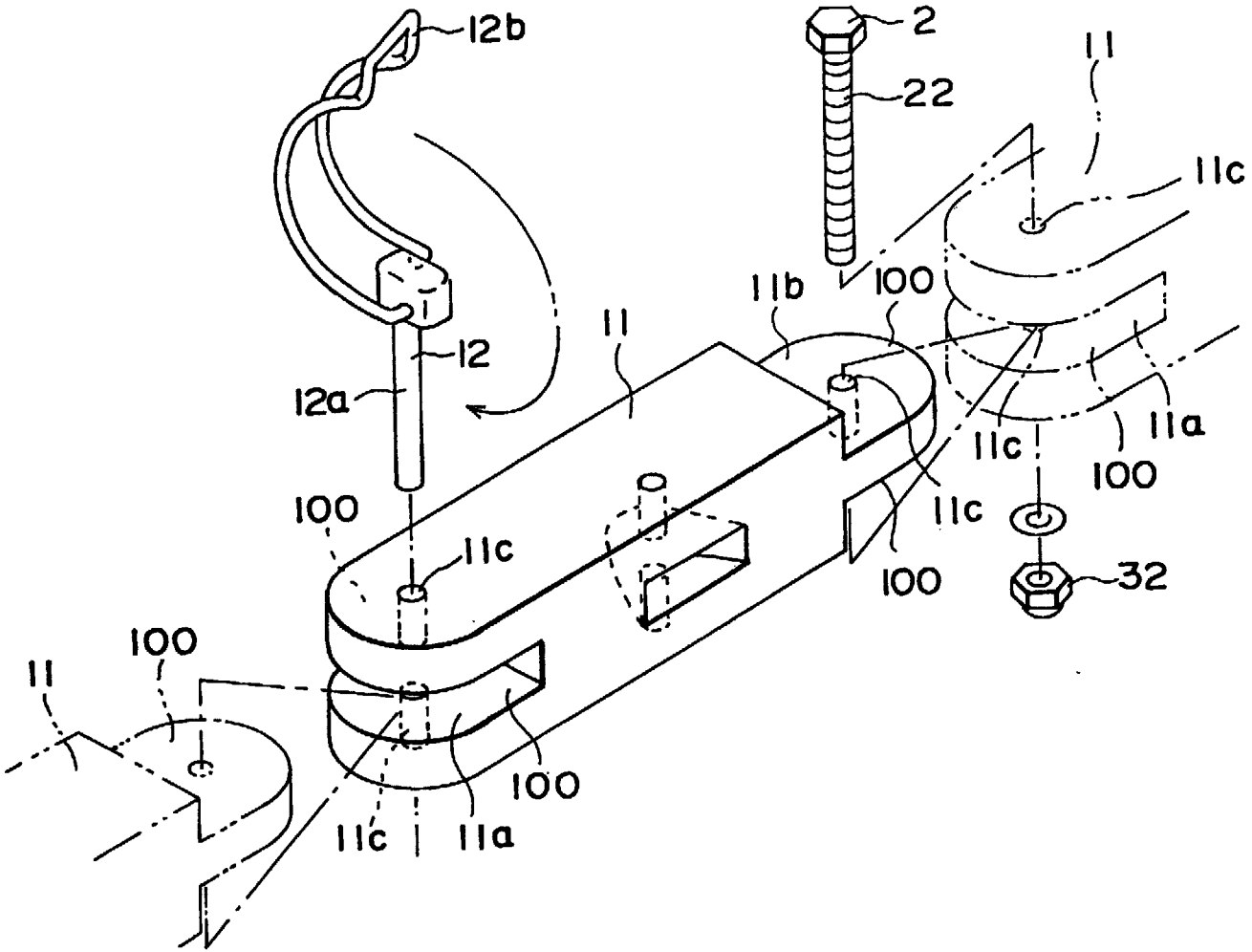
FIG. 2 is a fragmentary exploded perspective view of an assembly of dog members in a deposit removal system, showing the relation between a fastener for fastening dog members to each other and a spring pin.

The dog members 11 are composed of polyethylene, nylon, a polyacetal resin such as DURACON, or a similar engineering plastics material. As shown in FIG. 2, each dog member is generally in the shape of a rectangular parallelepiped, having at one end a convex, rounded shape, with a slot 11*a*, and at its other end a protruding tongue 11*b* also having a convex, rounded shape. The slot of each dog member has opposed flat, parallel faces 100, which are spaced apart by a distance just sufficient to receive the tongue of an adjacent dog member, the tongue also having opposite flat, parallel faces 100 spaced apart from each other by a distance slightly less than the width of the slot. When a tongue of one dog member is fitted into the slot of an adjacent dog member, a hole 11*c* in the tongue, perpendicular to the flat faces of the tongue, becomes aligned with holes 11*c* in the slotted end portion of the adjacent dog member to form a through hole which can receive a fastener 2. The fastener may be either a bolt with a nut 32, or, alternatively, a pin 12.

The pin 12, as shown in FIG. 2 is a generally known pin, which comprises a shank 12*a* and a curved, U-shaped spring 12*b* having its ends rotatably inserted into offset holes in the head of the pin.

Figure 3:
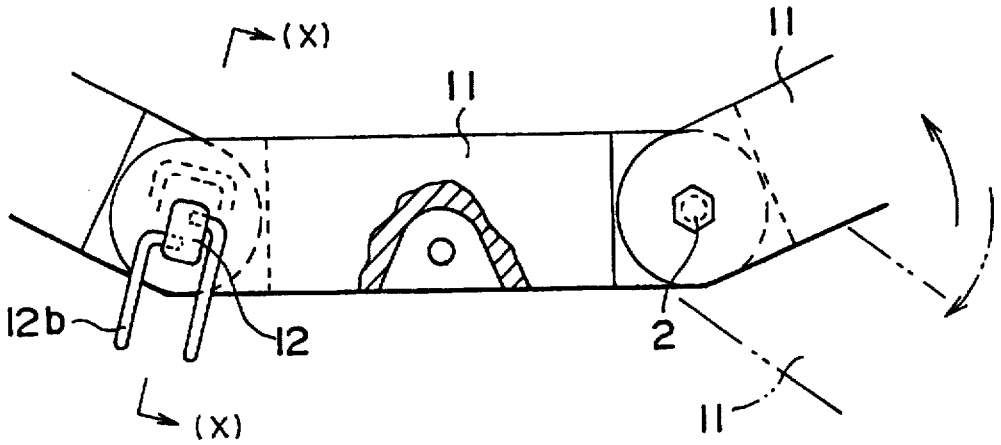
FIG. 3 is a top plan view of the assembly of FIG. 2.
Figure 4:
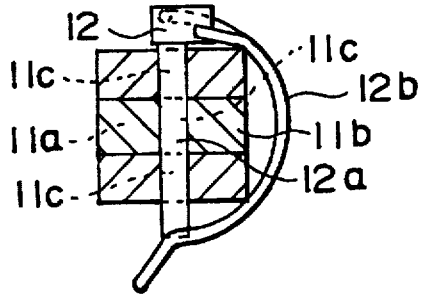
FIG. 4 is a sectional view taken on plane (X)—(X) in FIG. 3.

When the shank 12 of the pin is inserted into through hole 11, the spring can be rotated to a latching position shown in FIGS. 3 and 4 so that the spring extends around the joint of the connected dog members, thereby preventing unintended removal of the pin. The displacement of the ends of the spring from each other causes the tension in the spring to increase as the spring is rotated in the counterclockwise direction from the latching position in which it is shown in FIG. 4. Thus, the spring action tends to hold maintain the spring in the latching position, requiring a positive manually applied force to move the spring to release the pin. Preferably the spring is designed with a dead point between the fully opened and fully latched position, so that, on one side of the dead point, the spring tends to move toward the fully opened condition depicted in FIG. 1, and on the other side of the dead point, it tends to move toward the fully latched condition depicted in FIGS. 2 and 3. This action makes it easy for a worker to secure dog members together underwater.

Figure 6:
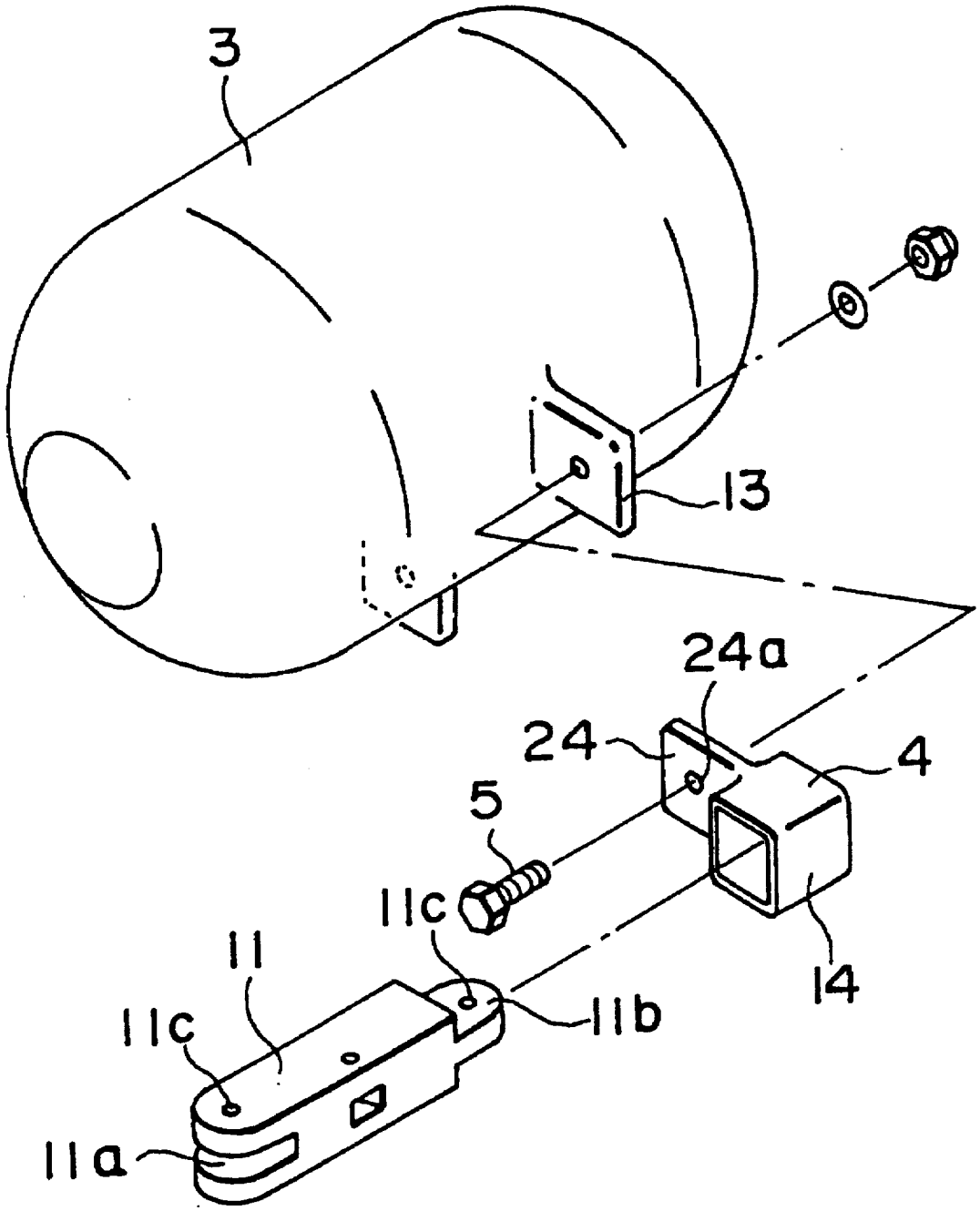
FIG. 6 is an exploded perspective view showing the relation between float, fitting, and dog member.

As shown in FIG. 6, the fitting 4, has a mounting plate 24 having a hole 24*a* extending from one side of a rectangular frame 14 having an opening for receiving a dog member 11. The frame is attached to one of the dog members of a ring in such a way that its mounting plate 24 extends radially outward. A mounting flange 13 protruding from a float 3 is secured to the mounting plate 24 by a bolt 5 extending through a hole 24 in the plate and a corresponding hole in the flange 13.

The float 3 is preferably hollow and formed of an expanded plastics material by an injection forming method. The protruding mounting flange is preferably formed as a unit with the float body.

Figure 1:
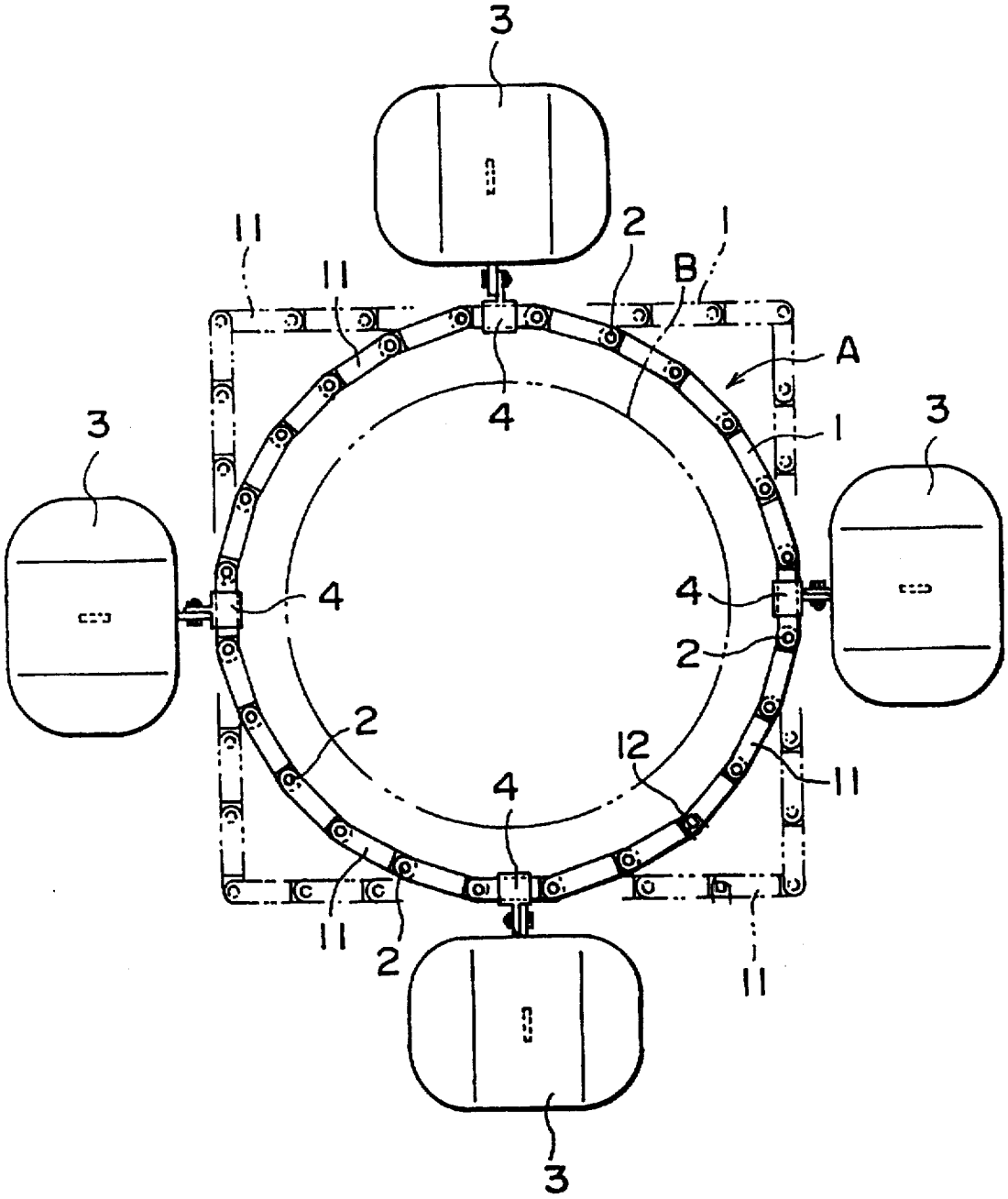
FIG. 1 is a top plan view showing a first embodiment of a floating-type deposit removal system of the invention.

The floating-type deposit removal system A, as shown in FIG. 1, is partially assembled by interconnecting a desired number of dog members 11 in the manner depicted in FIG. 2, using bolts 22, and by attaching an appropriate number of floats 3 in the manner depicted in FIG. 6. The dog members are connected in a line having two free ends not yet connected.

Figure 5:
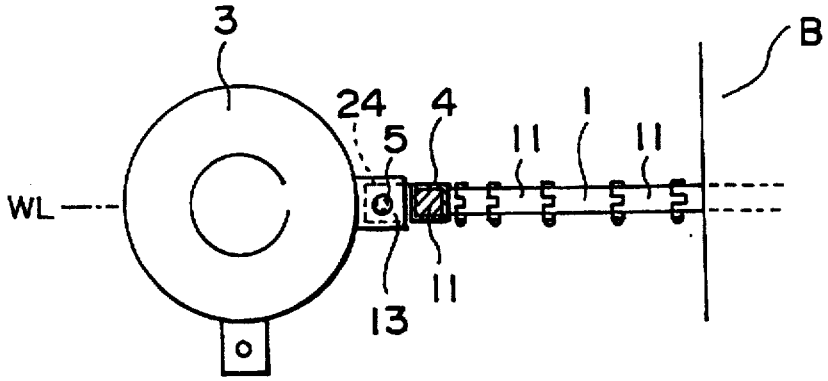
FIG. 5 is a locally enlarged front view showing how a float is secured to a deposit removal ring, the ring being shown in cross-section.

The partially assembled removal system A is brought up to a work site in a floating condition by a diver or other worker, and looped around an underwater structure B as shown in FIGS. 1 and 5. The dog members 11 at the free ends of the assembly are connected to each other by a pin 12, and the spring 12*b* is rotated to the latching condition.

Even if the underwater structure B is a rectangular pier or breakwater, it is possible to form removal structure into a shape conforming to the underwater structure on site by loosening and retightening the fasteners. Thus, for example, the dog members can be formed into a square ring having perpendicular corners, as shown in broken lines in FIG. 1. Any dog member can be rotated with respect to an adjoining dog member through a wide angular range, as depicted in FIG. 3.

By selecting an appropriate number of dog members and making the adjustments as described above, it is possible to form a deposit removal ring into a shape to conform to, and closely surround an underwater structure B. Thus, when the ring moves vertically in close relationship to the underwater structure under the influence of wave motion, tidal motion and tidal currents, effective removal of deposits is achieved.

Figure 7:
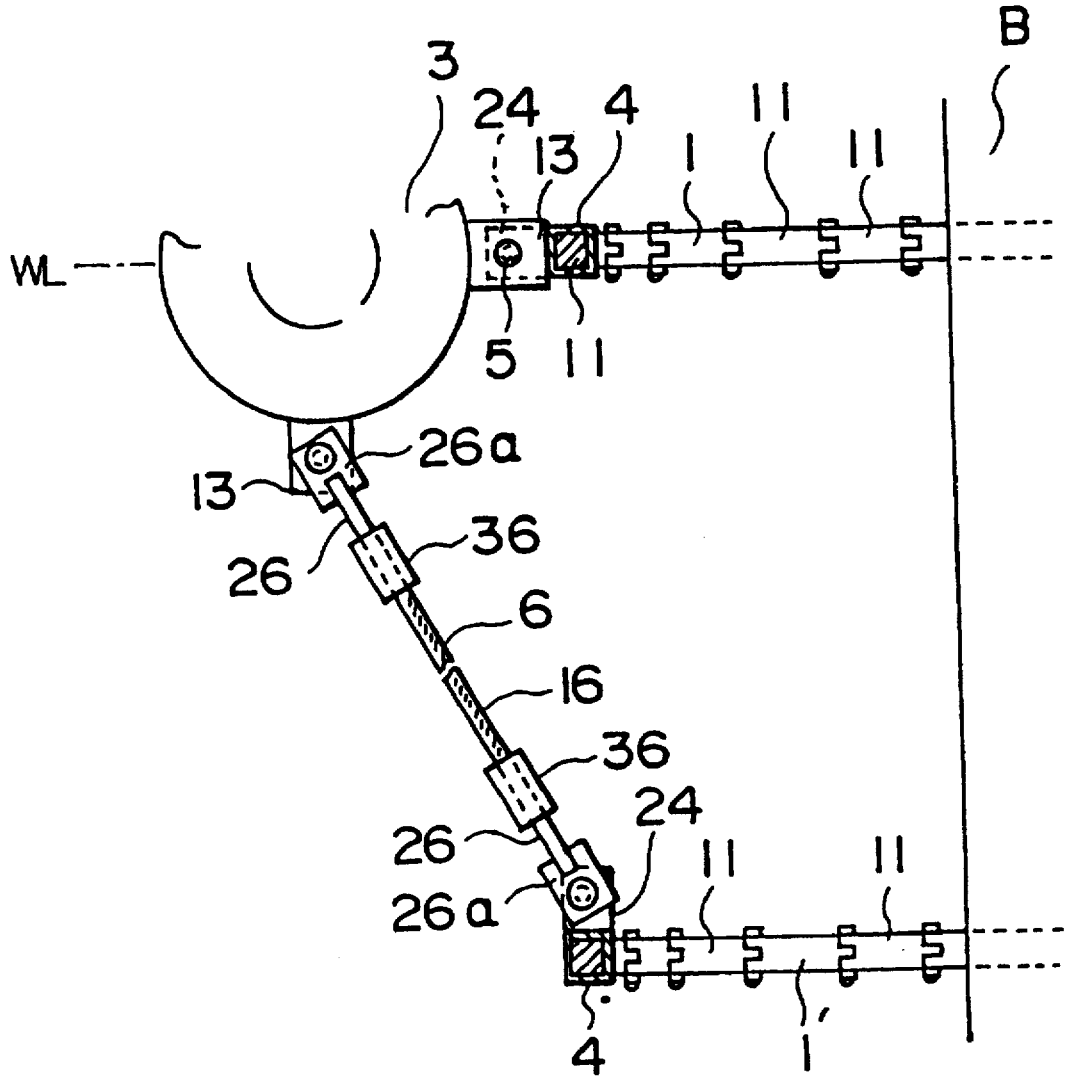
FIG. 7 is a fragmentary sectional view of a second embodiment, provided with a second deposit removal ring.
Figure 8:
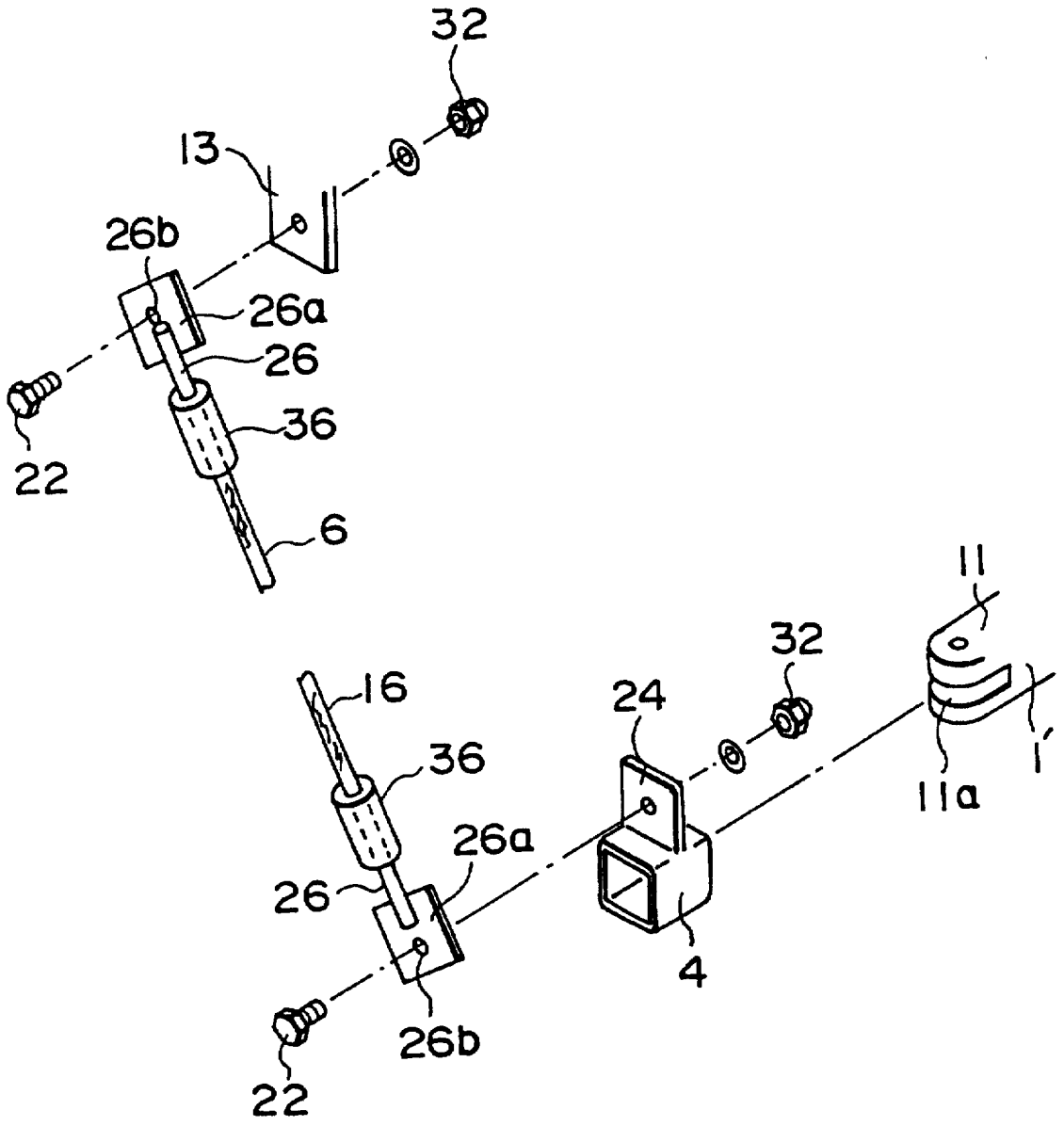
FIG. 8 is a fragmentary exploded perspective view showing the relation between a float and the second deposit removal ring in FIG. 7.

In the embodiment shown in FIGS. 7 and 8, a second deposit removal ring 1' is suspended from the float 3 through a hoisting accessory 6 one end of which is connected to a float 3 similar to that depicted in FIGS. 1, 5 and 6.

The second deposit removal ring 1' is substantially identical to the deposit removal ring 1 of FIG. 1, and corresponding parts are identically numbered.

The float 3 is an internally hollow product made of expanded plastic similarly to the case of the above embodiment and it is constituted so that the mounting flange 13 is integrally vertically formed from the central portion of the bottom as illustrated.

The fittings 4, by which the second ring 1' is suspended, have their mounting plates 24 extending upward, and the mounting plates 24 are connected with downwardly projecting mounting flanges 13 on the floats through the hoisting accessory 6.

The hoisting accessory 6 comprises a cable 16 with rods 26 at its ends. The connections of the rods 26 to the cable 16 are surrounded by protective collars. The rods 26 are provided with plates 26*a* having bolt holes 26*b*. The plates 26*a* are connected respectively to plate 24 on the second ring and to mounting flange 13 on the float, by bolts 22 and nuts 32.

The lower deposit removal ring 1' is assembled and installed in the same manner in which the deposit removal ring 1 is assembled and installed. Generally, however, the installation of the lower ring 1' will require a diver.

In the operation of the deposit removal system of this second embodiment, the upper deposit removal ring 1 floats on the water surface and the lower deposit removal ring 1' is located under the water. Both rings collide with the underwater structure under the influence of wave motion, tides and tidal currents to remove deposits.

In the embodiment shown in FIGS. 9 to 12, a retrieval device 7 is suspended under the above bottom deposit removal ring 1'.

Figure 9:
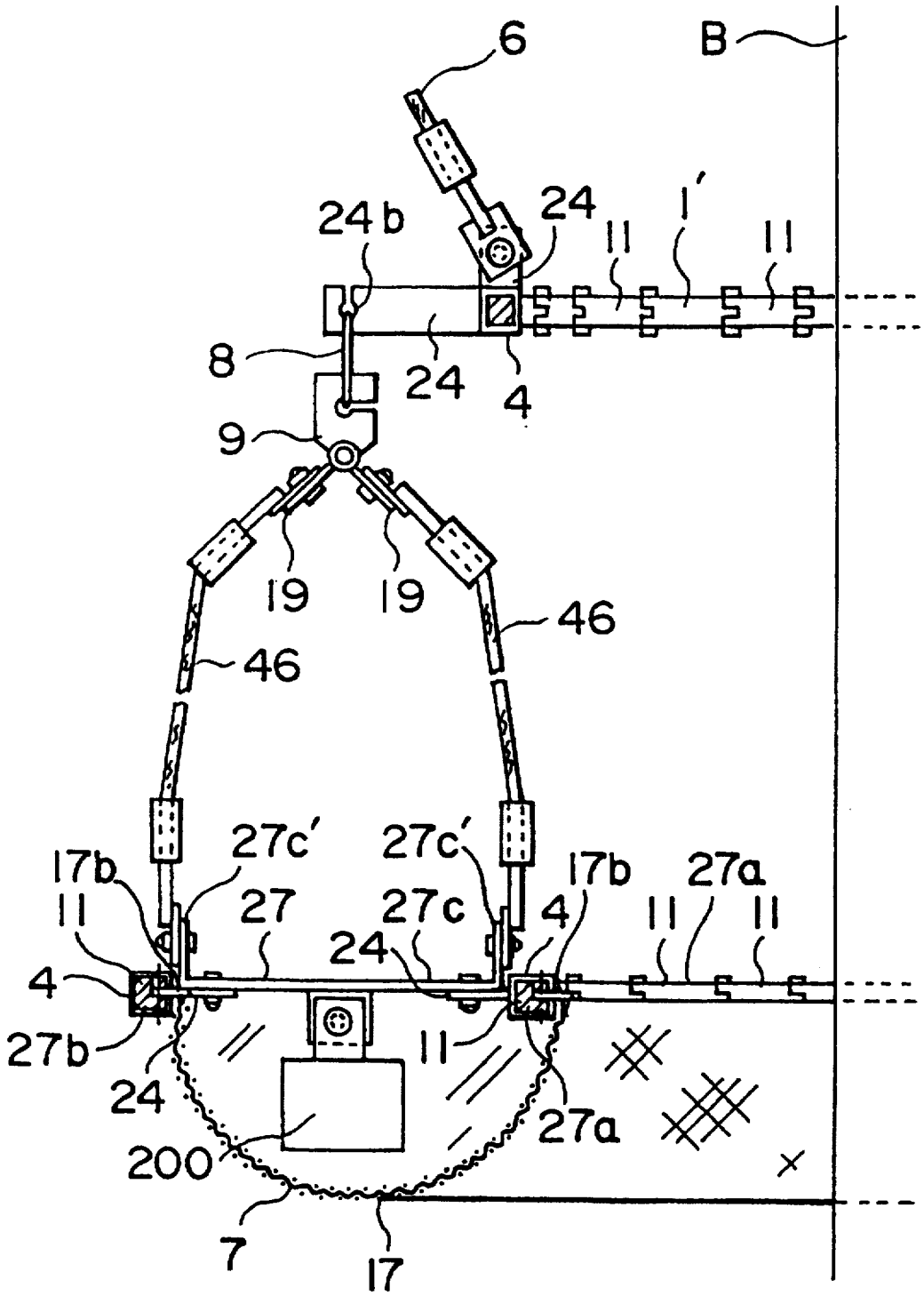
FIG. 9 is a fragmentary sectional view of a third embodiment, in which a retrieval net is connected to a bottom deposit removal ring.

As shown in detail in FIG. 9, the principal component of the retrieval device 7 is an annular net 17. A support 27 holds the net so that its cross section is generally U-shaped, and a hoisting accessory 46 is provided to connect connecting the support 27 with the bottom deposit removal ring 1' of a dual ring structure similar to that depicted in FIG. 7.

The net 17 is formed, for example, from rust-resistant stainless steel wire and has ropes or cables 17*a* (FIGS. 11 and 12) at both margins. Rings 17*b* are secured to the ropes 17*a* at equal intervals along their lengths.

Figure 10:
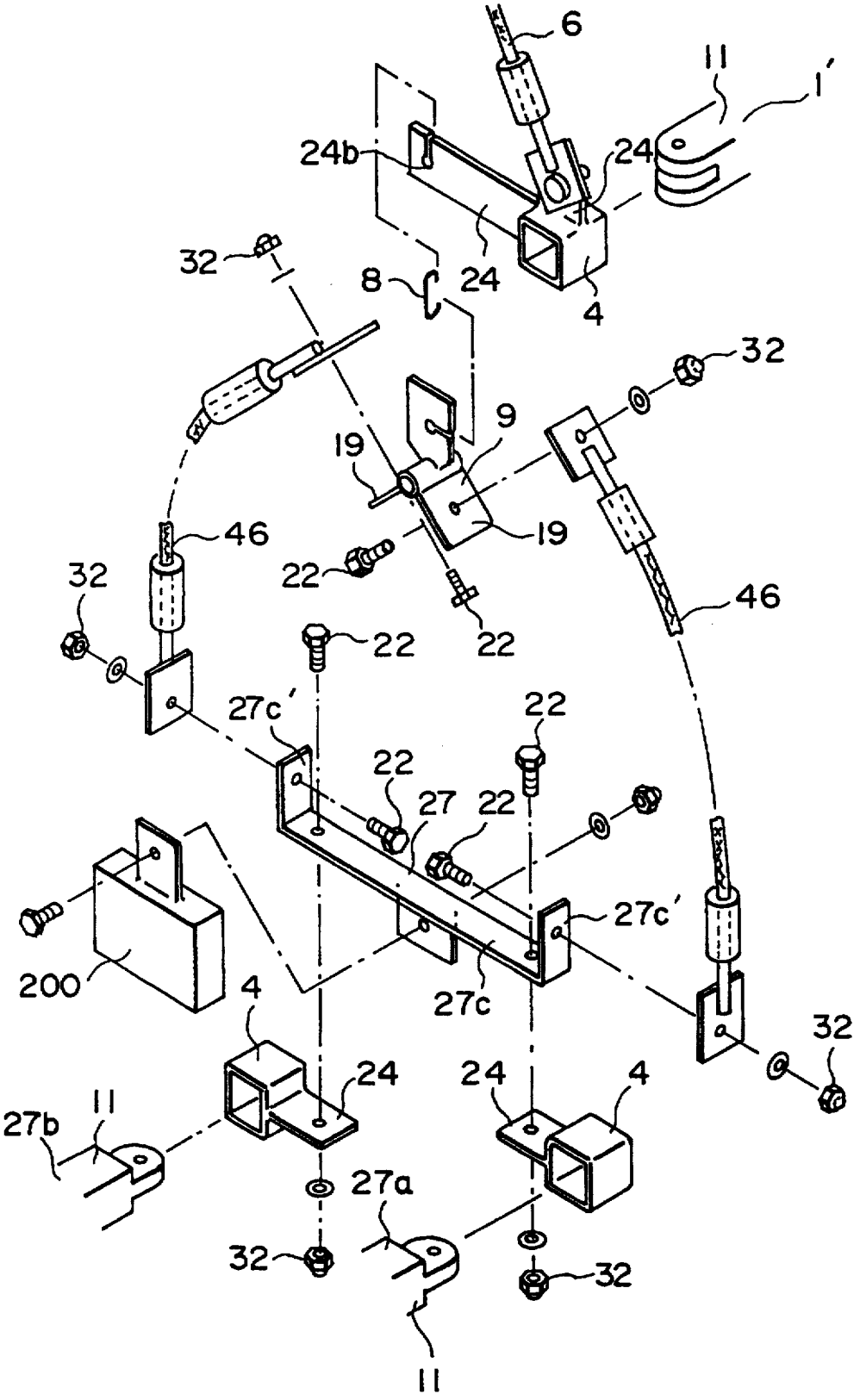
FIG. 10 is an exploded perspective view of a hoisting accessory used in the apparatus of FIG. 9.
Figure 11:
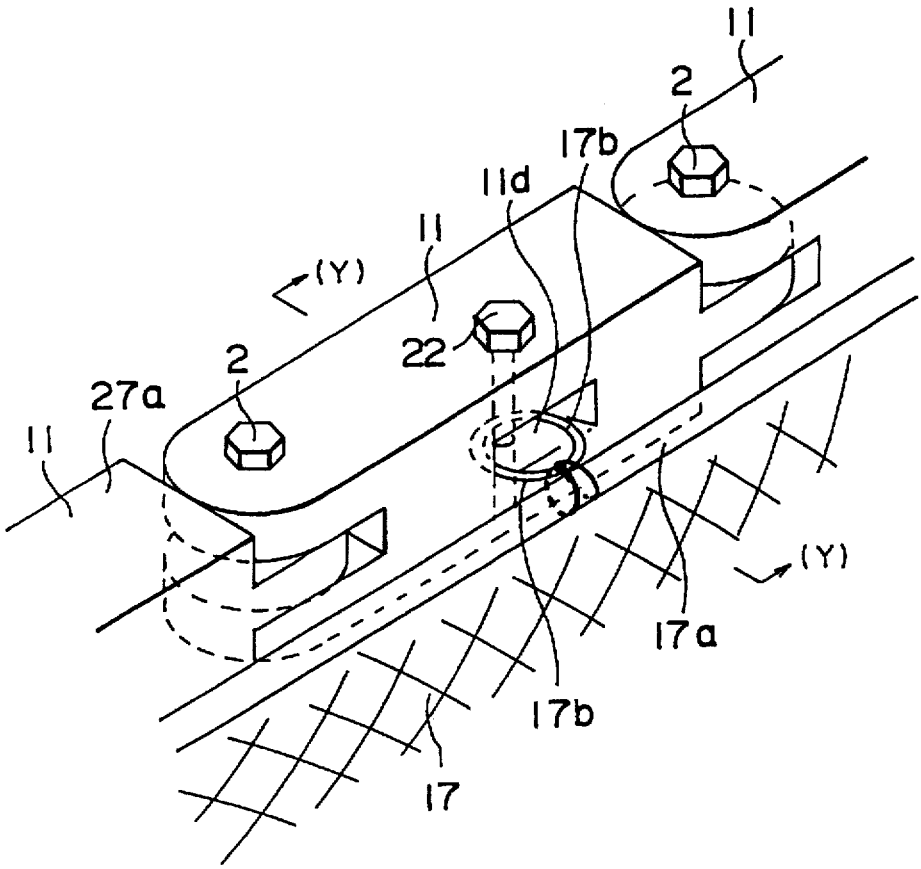
FIG. 11 is an enlarged fragmentary perspective view illustrating the manner in which a net body is secured to a deposit removal ring in the apparatus of FIG. 9.

The support 27 comprises an inner ring 27*a* and an outer ring 27*b* in concentric relation to each other. The rings 27*a* and 27*b* are made up of interconnected dog members 11, which are similar to the dog members constituting the above-described deposit removal rings 1 and 1'. The dog members 11 are fastened to one another by fasteners 2 as shown in FIGS. 10 and 11. A connecting plate 27*c* maintains the rings 27*a* and 27*b* at a fixed spacing from each other, and fittings 4 connect the rings to the plate 27*c*. The plate 27*c* is a preferably made of a rust-resistant stainless steel having upwardly extending flanges 27*c'* at both ends as shown in FIGS. 9 and 10.

As shown in FIG. 10, the mounting plates 24 of the fittings 4 on the inner ring project radially outwardly, while the mounting plates 24 of the fittings 4 on the outer ring project inwardly. These mounting plates are bolted to plate 27*c*.

Figure 12:
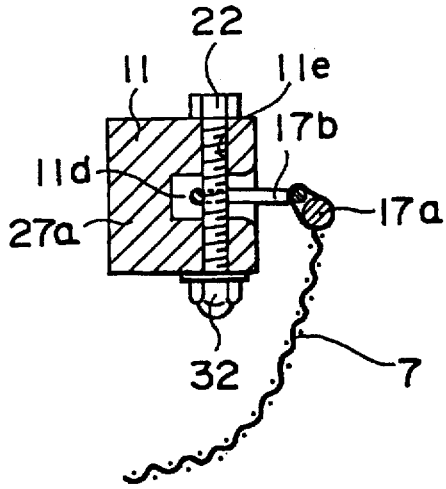
FIG. 12 is a sectional view taken on plane (Y)—(Y) in FIG. 11.

As shown in FIG. 12, a recess lid is provided in selected dog members 11 to receive a ring 17*b* to support the net 17. A net securing bolt 22 extends through a hole 11*e* and across the recess lid through the ring. The bolt is secured in place on the dog member by a nut 32. The net is attached to the inner and outer rings 27*a* and 27*b* in this manner at appropriate intervals.

As shown in FIGS. 9 and 10, a upper fitting 4, one of several attached to the dog members 11 of the lower deposit removal ring 1', has an upwardly projecting mounting plate and an outwardly projecting mounting plate 24. The upward mounting plate 24 is used for connection of the hoisting accessory 6, and the outward mounting plate 24 is used to hang the hoisting accessory 46 for the retrieval device 7, the latter being connected to upwardly projecting flanges 27*c'* of plate 27*c*.

The hoisting accessory 46 is similar to that of the embodiment shown in FIG. 8, except that it is hung on a notch 24*b* of the outwardly projecting mounting plate 24 by a C ring 8 connected to wings 19 of a Y-shaped connection body 9. A weight 200 is suspended from the spacer bar 27 to keep the retrieval device from floating.

The annular retrieval device 7 is suspended by several assemblies of the kind shown in FIGS. 9 and 10.

In the operation of the deposit removal apparatus depicted in FIGS. 9–12, deposits are removed from an underwater structure by upper and lower deposit removal rings, and the dropped deposits are caught by the retrieval device 7, which is located immediately underneath the rings. The inner ring 27*a* of the retrieval device also serves as a deposit removal ring in that it also contacts the underwater structure to remove deposits.

Figure 13:
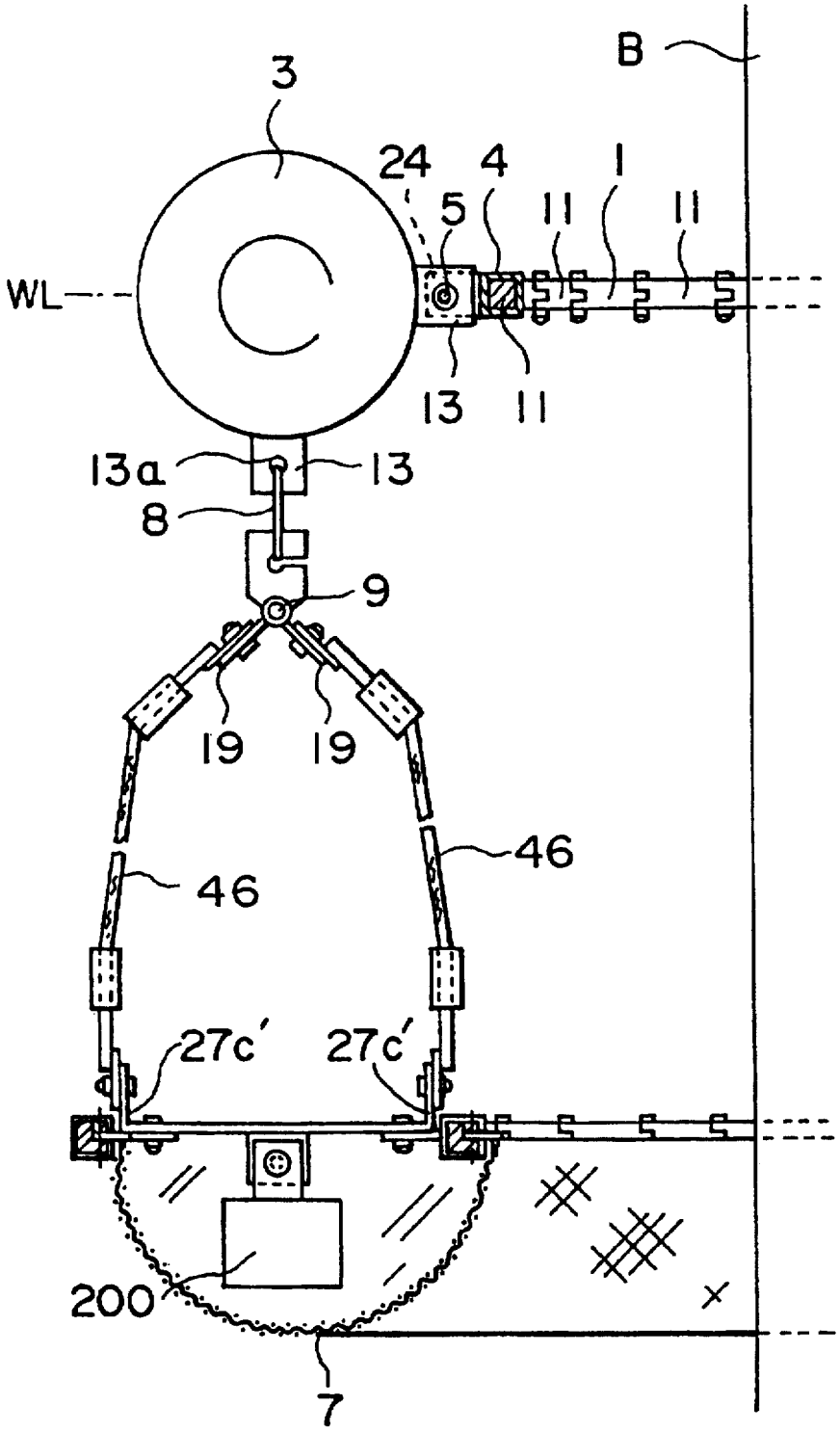
FIG. 13 is a fragmentary sectional view showing a fourth embodiment, in which a retrieval net is suspended from a float.

Still another embodiment, shown in FIG. 13, is similar to the embodiment of FIGS. 9–12, except that the intermediate deposit removal ring is eliminated, and the retrieval device is suspended directly from the floats.

The retrieval device 7 is suspended immediately under the deposit removal ring 1 by a C-ring 8, which is attached to a mounting hole 13*a* in a flange 13 projecting downward from a float 3. A Y-shaped connector 9, attached to the C-ring, has two wings 19 to which the upper ends of hoisting attachments 46 are connected. The lower ends of the hoisting attachments are connected to flanges 27*c'* on a spacer bar, which holds the inner and outer net-supporting rings in fixed relationship to each other. Here again, the retrieval device is annular in shape, with a U-shaped cross-section in vertical planes through the center of the annulus.

Figure 14:
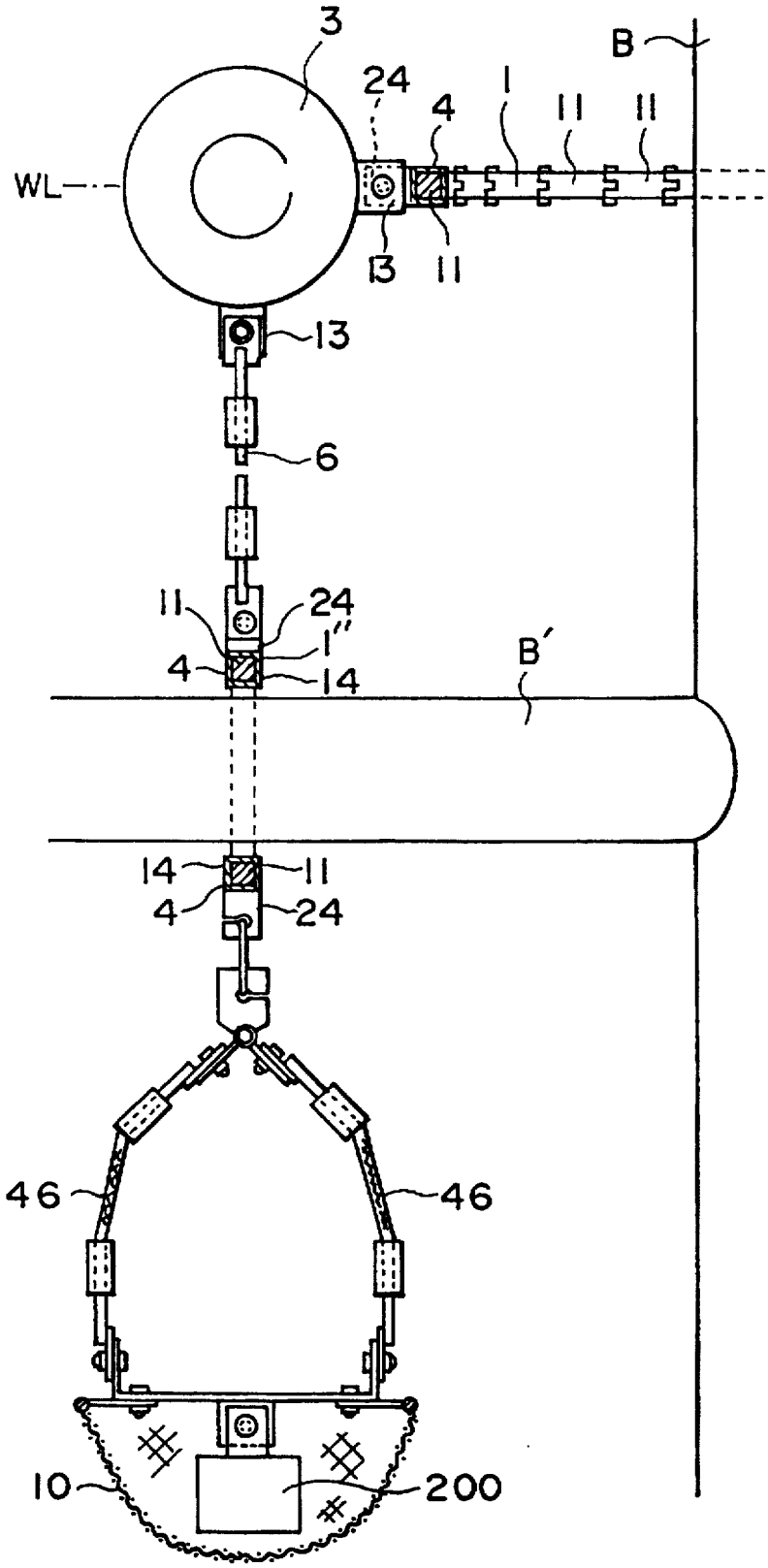
FIG. 14 is a front view showing a fifth embodiment, adapted to remove deposits from a horizontal underwater structure.

For removal of deposits from a horizontally extending underwater structure (including an obliquely extending structure such as a diagonal brace or the like), the embodiment shown in FIG. 14 can be used. Such underwater structures may be at depths as much as 6 to 10 meters or more from the surface.

A deposit removal ring 1", which is disposed in a vertical plane, is suspended by a hoisting accessory 6 from a horizontal deposit removal ring 1 floating on the surface. As in the case of the horizontal rings described above, the vertically disposed ring 11" is made up of a series of dog members 11 interconnected with one another in such a way that they can articulate about horizontal axes perpendicular to the plane in which the ring lies.

Essentially, the deposit removal ring 1" is equivalent to a horizontal deposit removal ring rotated into a vertical plane, and it is possible to convert one to the other easily.

As in the case of the horizontal deposit removal rings, the angles between the adjoining dog members 11 can be adjusted, and the ring can be installed about a horizontally extending underwater structure by assembling an appropriate number of dog members in a series having two free ends, wrapping the series of dog members about the underwater structure, and connecting the free ends by a pin having a spring latch as in FIGS. 2–4.

The deposit removal ring 1" is provided with fittings 4, one of which is connected to the uppermost dog member of the ring and the other of which is connected to the lowermost dog member. The upper fitting 4 is connected to the float through a hoisting accessory 6, and the lower fitting 4 is connected to a basket 10 through a hoisting accessory 46. The basket is suspended below the vertical ring 11" to retrieve deposits dropped as they are removed by ring 11" from the horizontal underwater structure B'. Here again a weight 200 is suspended from a brace extending across the top of the basket to ensure that the basket remains directly below the vertical deposit removal ring.

It will be apparent that the horizontal movement of the vertical ring 1" is limited to an distance only slightly greater than the difference between the diameters of the vertical structure B and the horizontal ring 1. Thus, in this embodiment, it may be desirable to use a relatively large diameter horizontal ring.

Instead of suspending the vertical ring from a float connected to a horizontal deposit removal ring, it is possible to suspend the vertical ring from a float connected through a cable to a marine structure or vessel, in which case the vertical ring can have a greater degree of freedom of movement along the horizontally extending underwater structure.

Figure 15:
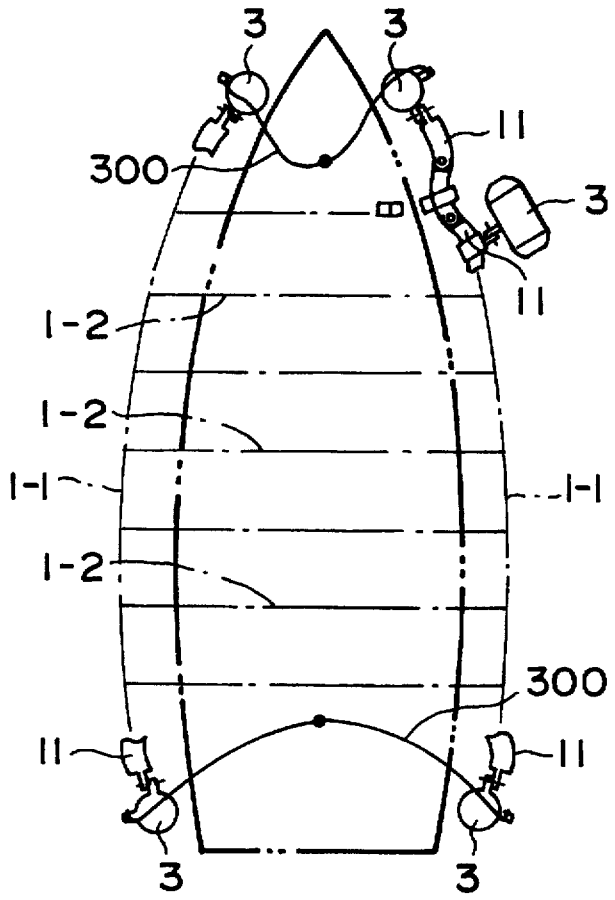
FIG. 15 is a schematic top plan view of a floating-type deposit removal system for removing deposits from the bottom of a ship.
Figure 16:
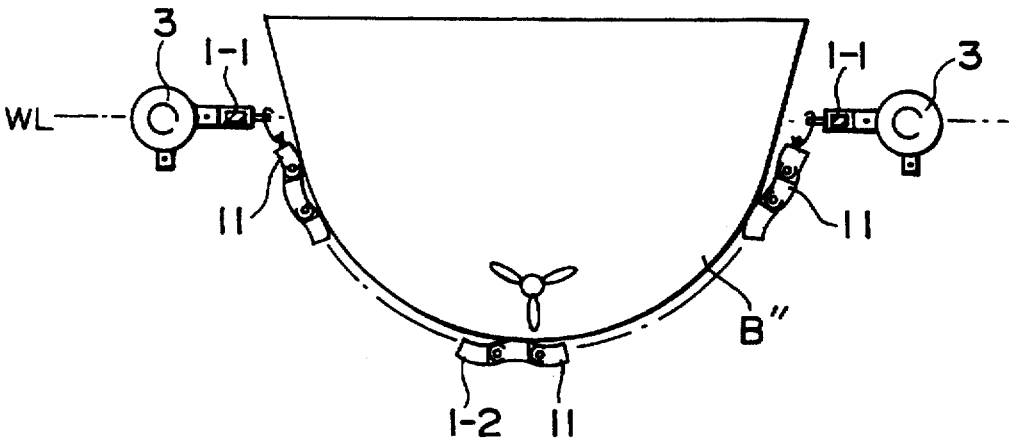
FIG. 16 is a schematic rear elevational view of the floating-type deposit removal system of FIG. 15.
Figure 17:
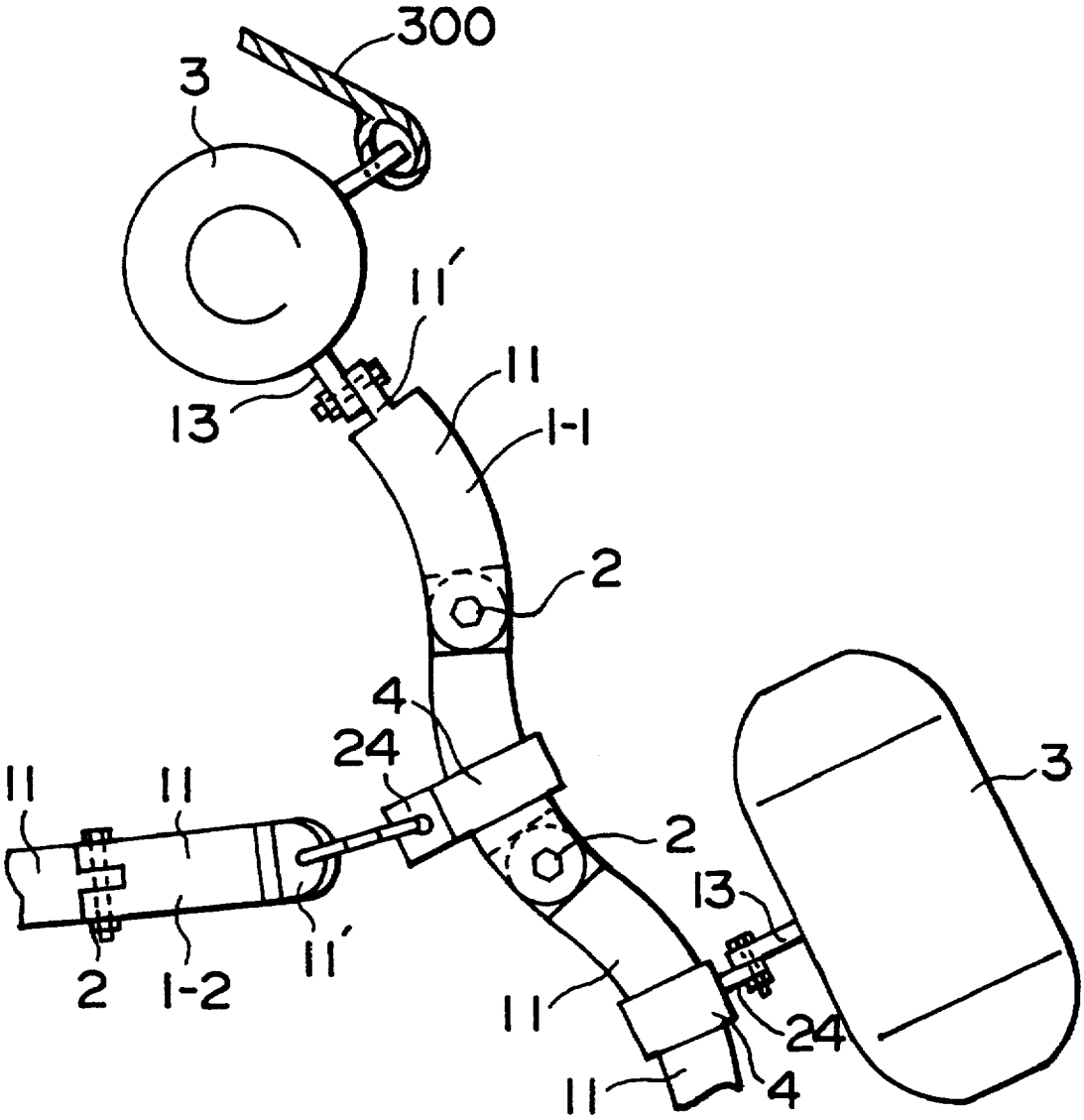
FIG. 17 is a locally enlarged, fragmentary, top plan view illustrating the essential connections between elements in the embodiment of FIG. 15.

The system shown in FIGS. 15 to 17 is used to remove deposits from a ship's bottom B" and preferably comprises a pair of elongated deposit removal structures 1-1 extending alongside the opposite sides of the ship, and a plurality of elongated deposit removal structures 1-2 extending athwartship, underneath the hull. The structures 1-1 are connected to, and supported by floats 3, which are connected to them by fittings 4. Likewise, the structures 1-2 are connected to structures 1-1 by similar fittings 4. Ropes 300 are used to connect the floats to the ship.

Each of the two longitudinal deposit removal structures 1-1 is approximately equal in length to the overall length of the ship. Unlike the parallelepiped dog members of the previously described embodiments, the dog members of structures 1-1 and 1-2 are curved as best shown in FIG. 17. Otherwise, they are similar to the parallelepiped dog members, and are interconnected by similar tongues and slots. The adjoining dog members have their ends alternately curved inward toward the hull and outward away from the hull so that the series of dog members has an undulating shape. Floats 3 are attached to the longitudinal deposit removal structures 1-1 at appropriate points to ensure that they remain afloat despite the weight of the athwartship deposit removal structures 1-2. Thus, in the preferred version of this deposit removal apparatus, floats 3 are attached to both ends of each longitudinal deposit removal structure 1-1 and additional floats (not shown) are attached to its middle portion as necessary.

As shown in FIGS. 15 and 17, mounting flanges 13 of the floats are attached to tongues on the dog members 11 at the both ends of the deposit removal structure 1-1, the aftmost dog member having tongues at both of its ends. Alternatively the mounting flange of the aftmost float can be secured to a slot in the aftmost dog member, in which case all of the dog members can be alike. Along the intermediate part of the length of the deposit removal structure 1-1, the mounting flange 13 of a float is secured to a mounting plate 24 of a fitting 4 on a dog member 11, as shown in FIG. 17.

The deposit removal structures 1-2 are similar to the deposit removal structures 1-1 except that they do not have floats. Plural deposit removal structures 1-2 are arranged in parallel to one another athwartship underneath the hull, with their ends connected to the longitudinal deposit removal structures 1-1.

The deposit removal structures 1-2 may have different lengths so that their dog members 11 rub the ship's bottom B" as much as possible under the influence of waves, tides and tidal currents.

The ends of the deposit removal structures 1-2 are connected by C-rings to inwardly projecting plates 24 on fittings 4 situated along the longitudinal deposit removal structures 1-1.

Ropes 300, are connected to flanges 13 which protrude outwardly from the float 3 at the ends of the longitudinal structures 1-1, and are secured to equipment (not shown) on the deck of the ship in such a way as to allow all of the deposit removal structures 1-1 and 1-2 to oscillate to rub the ship's bottom B" in response to wave action.

It is also possible to rub the bottom B" of the ship forcibly by disconnecting the ropes 300 at the stern and pulling the deposit removal structures 1-1 toward the bow. It is also possible to move the dog members 11 of both deposit removal structures irregularly by operating the ship's propeller and thereby producing a flow of water past the bottom of the ship.

The principal advantages of the invention described above may be summarized as follows.

First, a floating deposit removal ring in accordance with the invention moves in all directions as a result of wave forces and thereby contacts the surface of an underwater pile or similar structure in such a way as to remove deposits more efficiently and in a shorter time than was possible with conventional removal members capable only of repeated simple vertical movements.

A second advantage is that the deposit removal ring, being made up of disconnectible dog members which can be adjusted angularly relative to one another, can be made to conform to and fit closely around any of various underwater structures and thus more efficiently remove deposits without unnecessary movements.

Another advantage is that it is possible to make up the entire deposit removal ring from a series of identical dog members. Thus the structure is simplified and its cost is minimized.

Another advantage of the invention is that it is possible to utilize multiple deposit removal stages, for example in the form of two or more coaxial deposit removal rings, connected together by a hoisting structure, for greatly improved deposit removal efficiency.

Still another advantage of the invention is that the several versions having annular nets or baskets contribute to the maintenance of the environment immediately catching removed deposits so that they do not accumulate on the sea bottom or become scattered in the sea. Furthermore, because the net follows the movement of the deposit removal ring or rings, it remains at a location immediately under the deposit removal rings so that it more effectively catches dropped deposits.

The ring-receiving recesses in the dog members provide a simple and effective way to attach a deposit catching net to concentric inner and outer rings. It is possible to form all of the dog members with such recesses, and thereby simplify manufacture of the apparatus by reducing the number of different kinds of dog members needed.

The invention also has the advantage that a worker, e.g. a diver, can take advantage of the buoyancy afforded by floats to move a partially assembled deposit removal structure on the water surface, and easily wrap it around an underwater structure. Moreover, the pin and rotating U-shaped spring make it possible for the worker to attach the free ends of the deposit removal structure to each other easily in the water.

Still another advantage of the invention, in the case of a horizontal deposit removal ring, is that, by arranging the floats radially outward of the ring, it is possible to prevent deterioration of the floats and also to minimize the diameter of the deposit removal ring and utilize the entire ring for deposit removal.

The invention also makes it possible to remove deposits from a horizontally extending underwater structure conveniently by means of a vertically disposed ring having a structure similar to that of a horizontal ring. Moreover it is easy to convert a horizontal ring to a vertical ring, and vice-versa. Therefore, the invention makes it possible to remove deposits effectively from an of various underwater structures including horizontal braces and diagonal members.

The invention makes it possible to remove deposits from the bottom of a ship by taking advantage of wave motion and tidal forces to move deposit removal structures that extend both alongside and underneath the ship.

Finally, and especially in the case of removal of deposits from ships, curved dog members connected to one another in an alternating inwardly and outwardly curved arrangement, move irregularly for effective removal of deposits.

These and other advantages of the invention can be realized with various other configurations and modifications of the deposit removal structures described above without departing from the scope of the invention as defined in the following claims.

What is claimed is:

1. A floating-type deposit removal system comprising:

an elongate deposit removal structure adapted to contact a surface of an underwater structure in a body of water; and at least one supporting float connected to the deposit removal structure and adapted to float on the surface of said body of water;

wherein the deposit removal structure is constituted by a plurality of dog members, each dog member being a unitary, rigid element capable of directly contacting the underwater structure to remove deposits therefrom and having two ends, the dog members being arranged in end-to-end relationship in series along the length of the deposit removal structure, with an end of each dog member overlapping an end of an adjacent dog member, and with adjacent dog members linked to each other by a fastener which connects the overlapping ends thereof, and prevents the dog members from twisting relative to one another and from rolling on the underwater structure, while permitting articulation of said adjacent dog members relative to each other, whereby the shape of the deposit removal structure can be adjusted to accommodate the shape of the underwater structure.

2. A floating-type deposit removal system according to claim 1 in which the dog members are disposed in a ring.

3. A floating-type deposit removal system according to claim 1 in which the dog members are disposed in a horizontal ring, and in which each dog member has two opposite ends, with a tongue at one end and a tongue-receiving slot at the other end, the tongue of each dog member having upper and lower horizontal faces and being received in a tongue-receiving slot of an adjacent dog member, each slot having upper and lower horizontal surfaces in contact respectively with the upper and lower horizontal faces of a tongue, and in which each fastener which links a pair of adjacent dog members together and permits articulation thereof extends vertically through the upper and lower horizontal surfaces of one of said dog members of the pair and through the tongue of the other dog member of the pair.

4. A floating-type deposit removal system according to claim 1 in which the dog members are disposed in a horizontal ring, and including a second deposit removal structure constituted by a plurality of dog members disposed in series in a horizontal ring, with adjacent dog members of the second deposit removal structure linked to each other by a fastener which permits articulation of said adjacent dog members of the second deposit removal structure relative to each other, whereby the shape of the second deposit removal structure can also change to accommodate the shape of the underwater structure, and in which the rings are disposed in separate planes, one above the other, and connected to each other through a hoisting accessory.

5. A floating-type deposit removal system comprising:

an elongate deposit removal structure adapted to contact a surface of an underwater structure in a body of water; and at least one supporting float connected to the deposit removal structure and adapted to float on the surface of said body of water;

wherein the deposit removal structure is constituted by a plurality of dog members arranged in series along the length of the deposit removal structure, with adjacent dog members linked to each other by a fastener which permits articulation of said adjacent dog members relative to each other, whereby the shape of the deposit removal structure can be adjusted to accommodate the shape of the underwater structure; and wherein the dog members are disposed in a horizontal ring; and including annular retrieval means, suspended from said at least one supporting float, for catching dropped deposits removed by the ring from an underwater structure.

6. A floating-type deposit removal system comprising:

an elongate deposit removal structure adapted to contact a surface of an underwater structure in a body of water; and at least one supporting float connected to the deposit removal structure and adapted to float on the surface of said body of water;

wherein the deposit removal structure is constituted by a plurality of dog members arranged in series along the length of the deposit removal structure, with adjacent dog members linked to each other by a fastener which permits articulation of said adjacent dog members relative to each other, whereby the shape of the deposit removal structure can be adjusted to accommodate the shape of the underwater structure; and wherein the dog members are disposed in a horizontal ring; and including a second deposit removal structure constituted by a plurality of dog members disposed in series in a horizontal ring, with adjacent dog members of the second deposit removal structure linked to each other by a fastener which permits articulation of said adjacent dog members of the second deposit removal structure relative to each other, whereby the shape of the second deposit removal structure can also change to accommodate the shape of the underwater structure;

wherein the rings are disposed in separate planes, one above the other, and connected to each other through a hoisting accessory; and further including annular retrieval means, suspended from the second deposit removal structure, for catching dropped deposits removed by both deposit removal structures from the underwater structure.

7. A floating-type deposit removal system comprising:

an elongate deposit removal structure adapted to contact a surface of an underwater structure in a body of water; and at least one supporting float connected to the deposit removal structure and adapted to float on the surface of said body of water;

wherein the deposit removal structure is constituted by a plurality of dog members arranged in series along the length of the deposit removal structure, with adjacent dog members linked to each other by a fastener which permits articulation of said adjacent dog members relative to each other, whereby the shape of the deposit removal structure can be adjusted to accommodate the shape of the underwater structure;

wherein each dog member has two opposite ends, with a tongue at one end and two spaced elements defining a tongue-receiving slot at the other end;

wherein, for each adjacent pair of dog members, the tongue of one dog member of the pair is received in the slot of the other dog member of the pair;

wherein the fastener which links the adjacent dog members of at least one pair together and permits articulation thereof comprises a pin extending through the tongue of said one dog member and through the spaced elements of the other dog member, and a U-shaped spring having free ends inserted into holes at one end of the pin, the U-shaped spring being bent so that it can be situated in a latching position in which it extends, from said one end of the pin, around the spaced elements defining the tongue-receiving slot to a location adjacent to the opposite end of the pin, and in which the holes in which the free ends of the U-shaped spring are inserted being offset from each other so that, as the U-shaped spring is moved away from said latching position the tension in the spring increases, whereby the spring tends to remain in the latching position.

8. A floating-type deposit removal system according to claim 5, wherein the retrieval means comprises a net which is ring-shaped in plan view, means for supporting the net so that its cross-sections in vertical planes through the center of the annular retrieval means are generally U-shaped, and a hoisting accessory suspending said supporting means from said at least one supporting float, whereby the annular retrieval means is suspended from said at least one supporting float through said supporting means and said hoisting accessory.

9. A floating-type deposit removal system according to claim 6, wherein said annular retrieval means comprises a net which is ring-shaped in plan view, means for supporting the net so that its cross-sections in vertical planes through the center of the annular retrieval means are generally U-shaped, and a hoisting accessory suspending said supporting means from said second deposit removal structure.

10. A floating-type deposit removal system according to claim 5, wherein the retrieval means comprises a net which is ring-shaped in plan view, means for supporting the net so that its cross-sections in vertical planes through the center of the annular retrieval means are generally U-shaped, and a hoisting accessory suspending said supporting means from said at least one supporting float, whereby the annular retrieval means is suspended from said at least one supporting float through said supporting means and said hoisting accessory, and in which said supporting means comprises an inner ring and an outer ring for removably holding inner and outer margins of the net, and a rod maintaining the inner and outer rings in a predetermined relationship to each other, in which each of the inner and outer rings is constituted by plurality of dog members disposed in series, with adjacent dog members linked to each other by a fastener which permits articulation of said adjacent dog members about a vertical axis, and in which a plurality of loops are connected to the inner margins of the net and a plurality of loops are connected to the outer margins of the net, and each of a plurality of the dog members of each of the inner and outer rings has a recess receiving one of the loops and a net securing pin extending across the recess and through a loop received therein.

11. A floating-type deposit removal system according to claim 1 in which the dog members are disposed in a horizontal ring and in which all of the supporting floats are arranged radially outward of the ring.

12. A floating-type deposit removal system according to claim 1 in which the dog members are disposed in a ring lying substantially in a vertical plane, whereby the ring is capable of removing deposits from a horizontally extending underwater structure.

13. A floating-type deposit removal system according to claim 1 in which the elongate deposit removal structure extends underneath the hull of a floating vessel athwartship.

14. A floating-type deposit removal system for removing deposits from horizontally elongated underwater structures comprising:

a deposit removal ring adapted to surround and contact a surface of a horizontally elongated underwater structure in a body of water; and at least one supporting float connected to the deposit removal structure and adapted to float on the surface of said body of water; and means for suspending the deposit removal ring from the float, whereby the ring is disposed substantially in a vertical plane;

wherein the deposit removal ring is constituted by a plurality of dog members, each dog member being a unitary, rigid element capable of directly contacting the underwater structure to remove deposits therefrom and having two ends, the dog members being arranged in end-to-end relationship in series, with an end of each dog member overlapping an end of an adjacent dog member, and with adjacent dog members linked to each other by a fastener which connects the overlapping ends thereof, and prevents the dog members from twisting relative to one another and from rolling on the underwater structure, while permitting articulation of said adjacent dog members relative to each other about horizontal axes perpendicular to said plane, whereby the shape of the deposit removal ring can be adjusted to accommodate the shape of the underwater structure.

15. A floating-type deposit removal system for removing deposits from horizontally elongated underwater structures comprising:

a deposit removal ring adapted to surround and contact a surface of a horizontally elongated underwater structure in a body of water; and at least one supporting float connected to the deposit removal structure and adapted to float on the surface of said body of water; and means for suspending the deposit removal ring from the float, whereby the ring is disposed substantially in a vertical plane;

wherein the deposit removal ring is constituted by a plurality of dog members arranged in series, with adjacent dog members linked to each other by a fastener which permits articulation of said adjacent dog members relative to each other about horizontal axes perpendicular to said plane, whereby the shape of the deposit removal structure can be adjusted to accommodate the shape of the underwater structure; and including a basket, suspended from said deposit removal ring, for catching dropped deposits removed when said ring is brought into contact with a horizontal underwater structure.

16. A floating-type deposit removal system on a ship comprising:

two elongated supporting structures extending in the fore-aft direction along opposite sides of the ship, each having a length approximately equal to the overall length of the ship;

a plurality of elongated deposit removal structures each extending athwartship underneath the hull of the ship, each having a first end connected to one of the two elongated supporting structures and a second, opposite, end connected to the other of the two elongated supporting structures;

float means adapted to float on the surface of a body of water, and connected to the elongated supporting structures, for supporting the deposit removal structures whereby the deposit removal structures can contact and remove deposits from the bottom of the ship; and rope means for connecting the float means to the ship;

wherein each of the deposit removal structures is constituted by a plurality of dog members arranged in series, with adjacent dog members linked to each other by a fastener which permits articulation of said adjacent dog members relative to each other.

17. A floating-type deposit removal system according to claim 16, wherein each of the dog members is curved, and, along the length of each deposit removal structure, every second dog member has its ends curved toward the hull of the ship and intervening dog members have their ends curved away from the hull.

18. A floating type deposit removal system according to claim 16 in which each of the two elongated supporting structures extending in the fore-aft direction along opposite sides of the ship is also a deposit removal structure comprising a plurality of dog members arranged in series, with adjacent dog members linked to each other by a fastener which permits articulation of said adjacent dog members relative to each other.

* * * * *